United States Patent [19]

Gram

[11] 4,084,926

[45] Apr. 18, 1978

[54] ROTARY GEAR PUMP

[75] Inventor: Hans Gram, Vojens, Denmark

[73] Assignee: Brodrene Gram A/S, Vojens, Denmark

[21] Appl. No.: 768,733

[22] Filed: Feb. 15, 1977

[30] Foreign Application Priority Data

Feb. 25, 1976 Denmark ..... 793/76

[51] Int. Cl.[2] ..... F04C 15/04

[52] U.S. Cl. ..... 418/19; 418/29; 418/46; 418/78

[58] Field of Search ..... 418/19, 29, 46, 75, 418/78, 107, 108, 109, 169, 170; 417/440

[56] References Cited

U.S. PATENT DOCUMENTS

| | | | |
|---|---|---|---|
| 1,486,836 | 3/1924 | Hill | 418/19 X |
| 1,660,464 | 2/1928 | Wilsey | 418/19 X |
| 1,672,257 | 6/1928 | Heitz | 418/169 |
| 2,948,228 | 8/1960 | Ahlen | 418/19 |
| 3,876,349 | 4/1975 | Svensson | 418/169 |

*Primary Examiner*—Carlton R. Croyle
*Assistant Examiner*—Leonard Smith
*Attorney, Agent, or Firm*—Watson, Cole, Grindle & Watson

[57] ABSTRACT

A rotary gear pump comprising two excentrically arranged gear wheels of different sizes, of which the greater gear wheel is rotatably mounted in the generally cylindrical housing of the pump and the smaller gear wheel is mounted upon a shaft which is arranged excentrically in the housing of the pump in such a way that the teeth of the two gear wheels, in the working condition of the pump, are mutually engaged along an area of the inner circumference of the housing of the pump between the outlet of the pump and the inlet of the pump, and are arranged with an interspace between the top circles of the teeth along another part of the circumferences of the wheels, a blocking member being arranged in the interspace with one surface of the blocking member sealing against teeth of the smaller gear wheel and with another surface of the blocking member sealing against teeth of the greater gear wheel, wherein the shaft and the blocking member are mounted rotatably in the housing about the axis of the greater gear wheel together with an element of the housing wherein a duct is provided which, as seen in the circumferential direction of the housing, extends along an angle which is greater than the angle between the inlet of the pump and the outlet of the pump, said duct, moreover, being offset in the circumferential direction with respect to the area along which the greater and the smaller gear wheels engage.

3 Claims, 9 Drawing Figures

ROTARY GEAR PUMP

BACKGROUND OF THE INVENTION

This invention relates to a rotary gear pump of the kind comprising two excentrically arranged gear wheels of different sizes, of which the greater gear wheel is rotatably mounted in the generally cylindrical housing of the pump and the smaller gear wheel is mounted upon a shaft which is arranged excentrically in the housing of the pump in such a way that the teeth of the two gear wheels, in the working condition of the pump, are mutually engaged along an area of the inner circumference of the housing of the pump between the outlet of the pump and the inlet of the pump, and are arranged with an interspace between the top circles of the teeth along another part of the circumferences of the wheels, a blocking member being arranged in the interspace with one surface of the blocking member sealing against teeth of the smaller gear wheel and with another surface of the blocking member sealing against teeth of the greater gear wheel.

A rotary gear pump of this kind is known from French patent specification No. 1528508. According to this prior art one of the gear wheels is arranged so as to be movable in the axial direction of the pump with respect to the other gear wheel in order to create an interspace in the housing of the pump between one side surface of the smaller gear wheel and the opposite side surface of a disc which along its circumference is provided with axially extending projections which form the greater gear wheel. When the pump has been adjusted in this way it allows a flow of fluid to pass through the pump which is far greater than the normal capacity of the pump, viz. the capacity which is achieved due to rotation of the gear wheels when engaged with each other. However, this sort of shiftability requires a long housing for the pump, as seen in the axial direction, because sufficient space must be provided for the axial shifting of one of the gear wheels. Moreover, in order to avoid jamming of the shiftable gear wheel during the shifting it is necessary to provide long guiding means for the movable gear wheel.

SUMMARY OF THE INVENTION

According to the present invention the shaft and the blocking member of the rotary gear pump are rotatably mounted in the housing about the axis of the greater wheel together with an element of the housing wherein a duct is provided which, as seen in the circumferential direction of the housing, extends along an angle which is greater than the angle between the inlet of the pump and the outlet of the pump, said duct, moreover, being offset in the circumferential direction with respect to the area along which the greater and the smaller gear wheels engage. A rotary gear pump constructed in accordance with the principle of the present invention is easily shiftable from the normal working condition, viz. where the flow through the pump is transported by means of the mutually engaged rotating gear wheels, and into a condition wherein the pump may be passed by a highly increased flow, e.g. for flushing or washing the plant to which the pump belongs, because it is sufficient to rotate the element of the housing wherein the duct is provided to a position wherein one end of the duct is positioned adjacent the inlet of the pump and the other end of the duct is positioned adjacent the outlet of the pump. In such position of the duct the pump may be flushed or washed by a flow of rinsing or washing liquid which is far greater than the normal capacity of the pump. Due to the fact that the shifting is carried out by a simple rotation no surplus length of the housing is required and, moreover, it is easy to secure the movable element against jamming. Moreover, such shifting by rotation may easily be carried out both manually and automatically. Accordingly, a manually operated plant wherein a pump according to the present invention forms a part, may easily be converted from manual to automatic operation. Depending upon the size of the angle along which the duct extends and the position of the duct it is, moreover, possible by rotating the element wherein the duct is provided in such a way that the area of engagement between the gear wheels is moved away from the part of the inner circumference of the housing extending between the outlet of the pump and the inlet of the pump, to obtain a further possibility to flush the interspace between the tops and the flanks of the teeth of the two gear wheels. Such further flushing possibility may be further increased by means of an embodiment of the pump according to the present invention which is characterized by the length of the blocking member, as seen in the circumferential direction, is less than the length, also as seen in the circumferential direction, of the interspace between the top circles of the two gear wheels, and wherein one of the ends of the duct is positioned approximately at one end of the blocking member. According to this embodiment it is achieved that a flushing possibility, by the shifting of the pump, will also be created through a portion of the interspace between the top circles of the gear wheels, viz. the portion which otherwise would be occupied by a blocking member having the normal length for pumps of the kind here in question. Normally, the blocking member fills the interspace between the top circles of the teeth of the excentrically arranged gear wheels completely. According to a still further embodiment of the present invention the rotatability of the element of the housing wherein the duct is provided may be sufficient for shifting the area of engagement between the teeth of the two gear wheels from one side of the inlet of the pump to the other side thereof. By means of such embodiment it is achieved that the possibility to flush the pump will be at a maximum.

DESCRIPTION OF THE PREFERRED EMBODIMENTS

Figure 1:
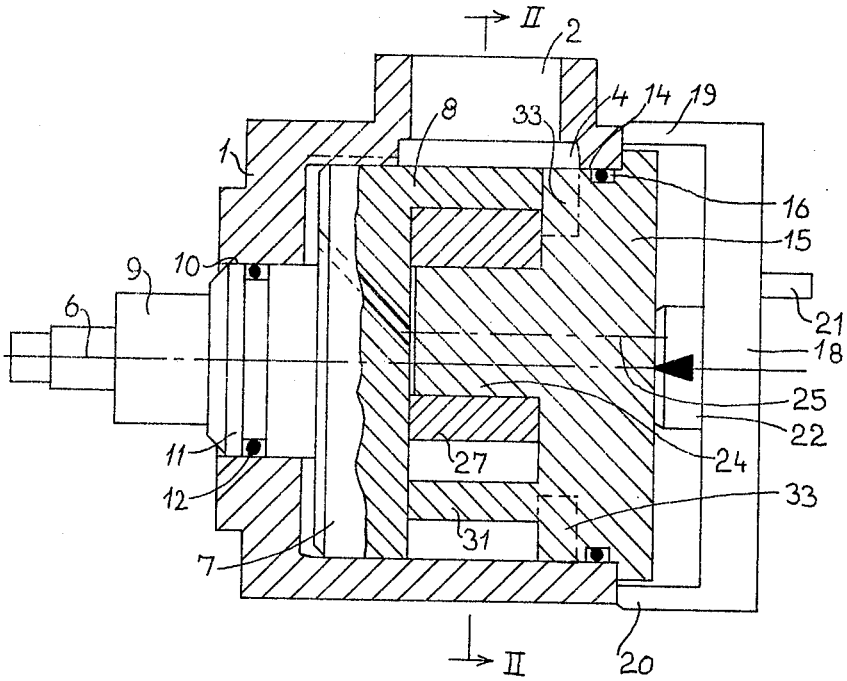
FIG. 1 is an axial section of an embodiment of the gear pump according to the invention under normal working condition.

In the drawings, 1 is the housing of the pump. The housing is provided with an inlet 2 and an outlet 3, each of which via a diverging section 4 and 5, respectively, opens into the cavity of the housing. With the exception of the diverging sections 4 and 5, the cavity of the housing is cylindrical. The outlet 3 and the inlet 4 has a mutual angle distance of 90°. 6 designates the centre line of the cylindrical cavity or interior of the housing. A disc 7 is rotatably mounted in the interior of the housing coaxially with the centre line 6. Along the circumference the disc 7 is provided with axially extending projections 8 each of which has a tooth-formed cross section and, accordingly, the projections 8 together with the disc 7 form a gear wheel. A drive shaft is secured to the disc and extends through a bore 10 in the housing. The shaft is sealed in the bore by means of a o-ring 12 which is seated in a groove in a shoulder 11 of the shaft 9. The shaft 9 is intended to be connected to a drive motor (not shown).

Figure 2:
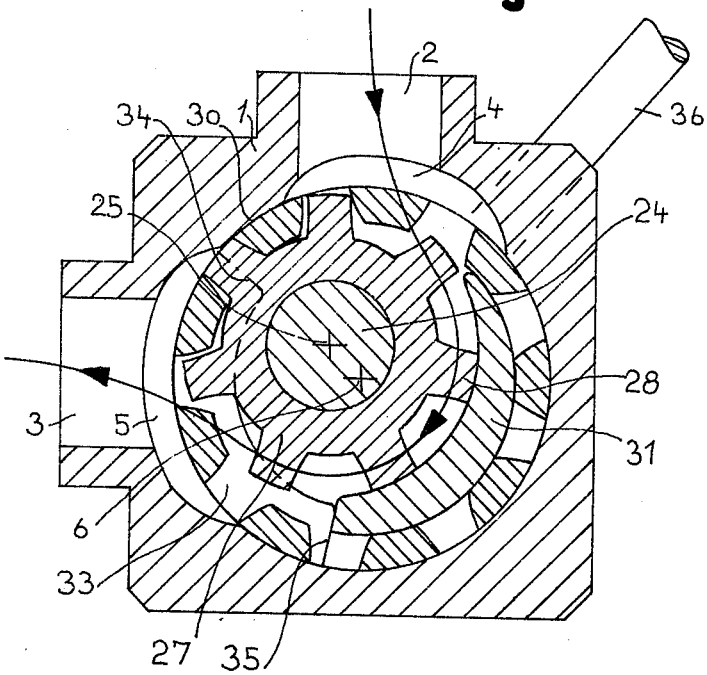
FIG. 2 is a section along the section line II—II on FIG. 1.

At the side of the housing 1 opposite the bore 10 the housing is open as shown at 14. The opening 14 forms an axial extension of the cylindrical interior or cavity of the housing and serves to partly accomodate a housing element 15 which serves as a cover for the cavity. The cover 15 is sealed with respect to the opening 14 by means of an o-ring. A U-shaped clamp 18 is secured to the housing by means of a clutch (not illustrated), e.g. a bayonet socket to which the two legs 19 and 20 of the clamp are secured. Via a pipe stub 21 compressed air may be fed to the clamp 18 in order to press a pressure shoe 22 against the outer surface of the cover 15 in order to maintain the cover in its position during the operation of the pump. Along the inner surface the cover 15 supports a cylindrical shaft 24 the centre line of which extends excentrically with respect to the centre line 6 of the cavity of the housing. A gear wheel 27 the size of which is smaller than the size of the gear wheel mentioned above is rotatably mounted upon the shaft 24. 28 designates the teeth of the gear wheel 27. As it appears from FIG. 2 an imaginary line between the centre line 6 of the housing and the centre line 25 of the shaft 24 extends approximately along the bisector for the angle formed by the centre lines of the inlet 2 and the outlet 3 and, accordingly, the two gear wheels are in sealed engagement with one another along an area 30 of the inner wall of the housing which is positioned between the outlet 3 and the inlet 2. Diametrically with respect to the area 30 the two top circles (not shown for the sake of clarity) of the two gear wheels, form an interspace wherein a blocking member having sickle-shaped section is positioned. The blocking member 31 is secured to the inner surface of the cover 15 and is so arranged that the inner surface of the blocking member engages with the tooth tops of the smaller gear wheel whereas the outer surface of the blocking member engages with the tooth tops of the greater gear wheel.

During normal operation the shaft 9 is rotated clockwise (FIGS. 2 and 3) whereby the greater gear wheel 8 is rotated and rotates the smaller gear wheel. Due to the positioning of the engagement area, suction will be caused at the inlet 2 and inflow will be caused in the interspace between the two gear wheels via the diverging section 4 which compensates for the narrowing of the flow area caused by the teeth of the greater gear wheel. During the suction operation the pockets between the teeth will be filled with material to be pumped and the material will by means of the tooth pockets be moved along the opposite side surfaces of the blocking member 31 until the material will be expelled through the outlet 3 where the teeth will start to re-engage. The engagement between the teeth of the gear wheels will be completed at the area between the outlet 3 and the inlet 2.

Figure 3:
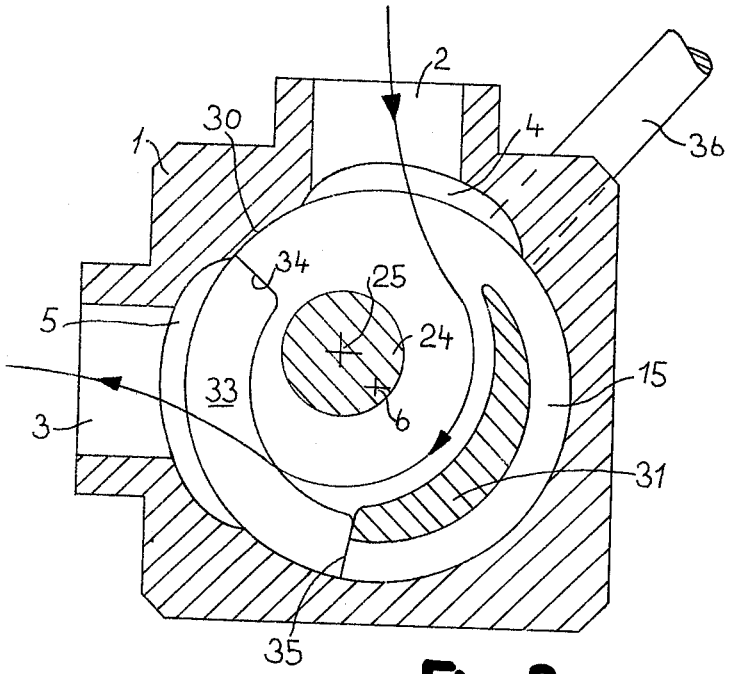
FIG. 3 is a section corresponding to FIG. 2, wherein, however, the gear wheels of the pump have been omitted in order to clearly illustrate the flow through the pump.
Figure 4:
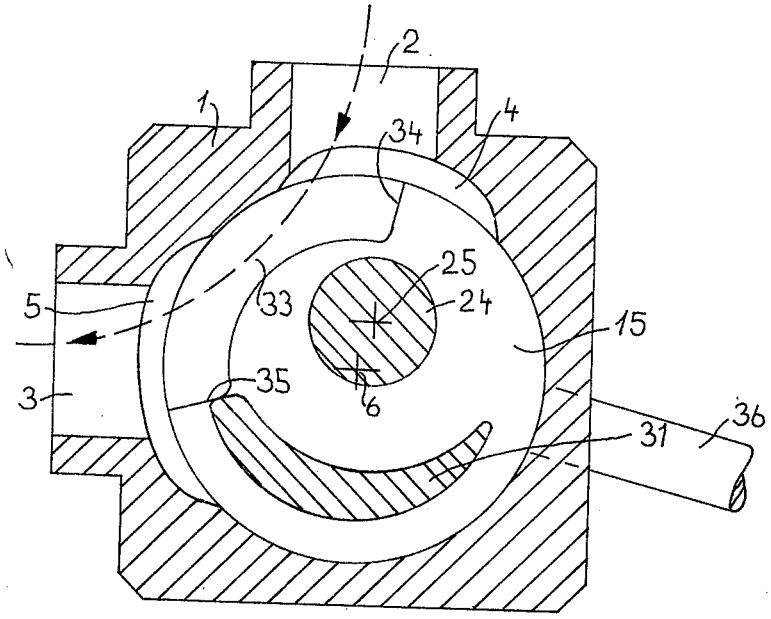
FIG. 4 is a section corresponding to FIG. 3, wherein, however, the pump has been shifted into a position for flushing.
Figure 5:
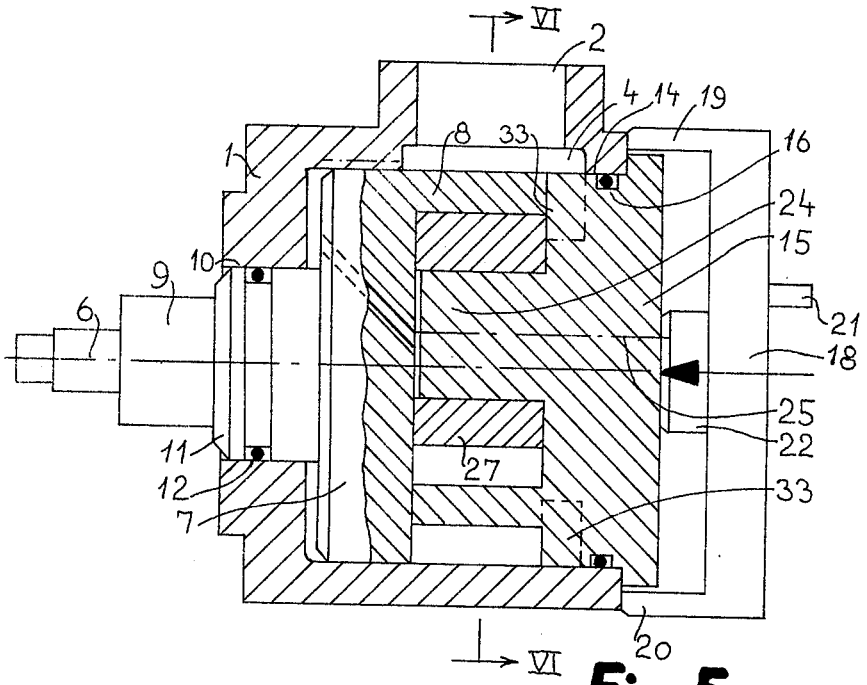
FIG. 5 is an axial section of another embodiment of the pump according to the present invention.
Figure 6:
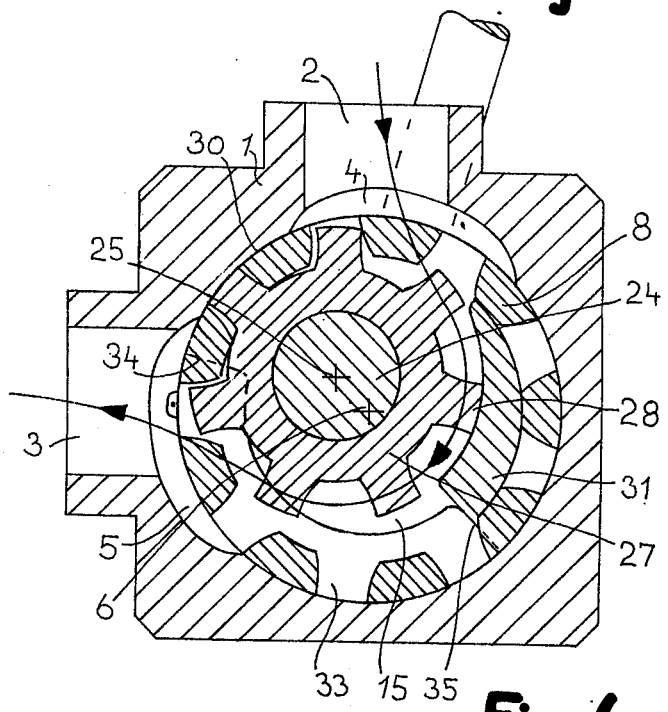
FIG. 6 is a section along the section line IV—IV on FIG. 5.
Figure 7:
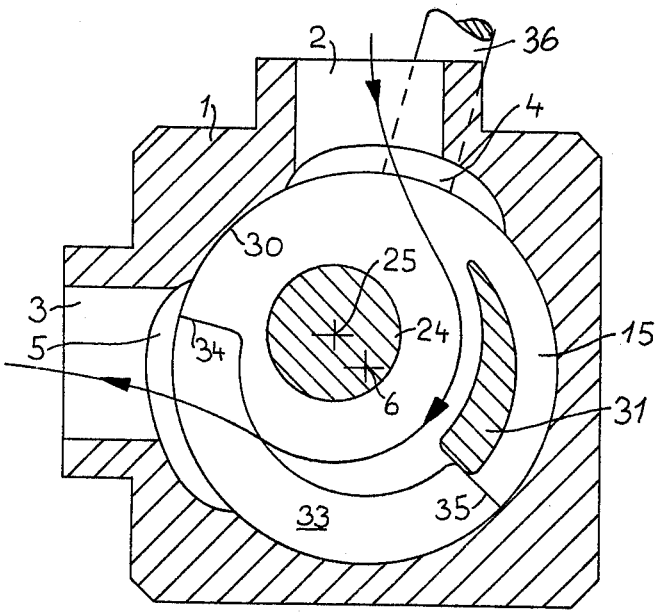
FIG. 7 is a section corresponding to FIG. 6, wherein, however, the gear wheels of the pump have been removed in order to illustrate the flow through the pump during normal operation.
Figure 8:
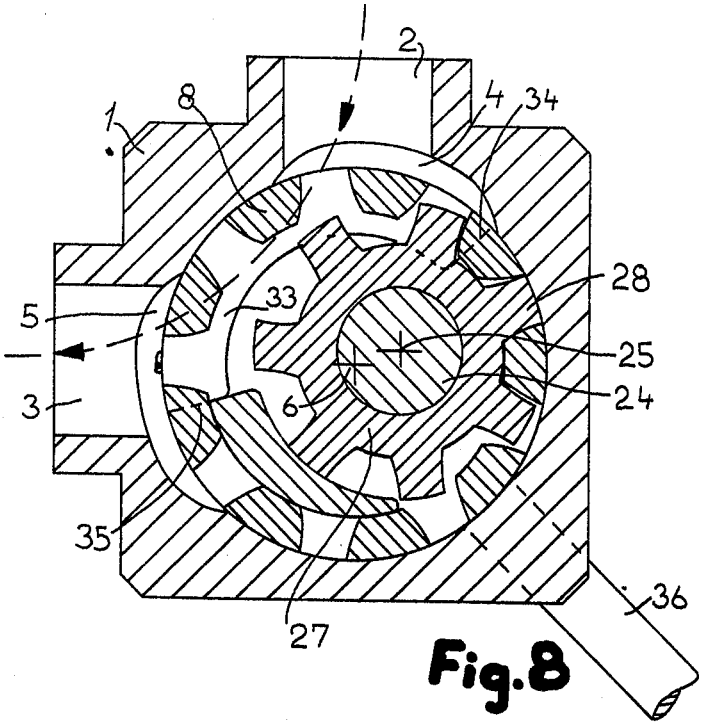
FIG. 8 is a section corresponding to FIG. 6, wherein the pump has been shifted into a condition for flushing and, FIG. 9 is a section corresponding to FIG. 8, wherein, however, the gear wheels of the pump has been removed in order to illustrate the flushing of the pump in its shifted condition.
Figure 9:
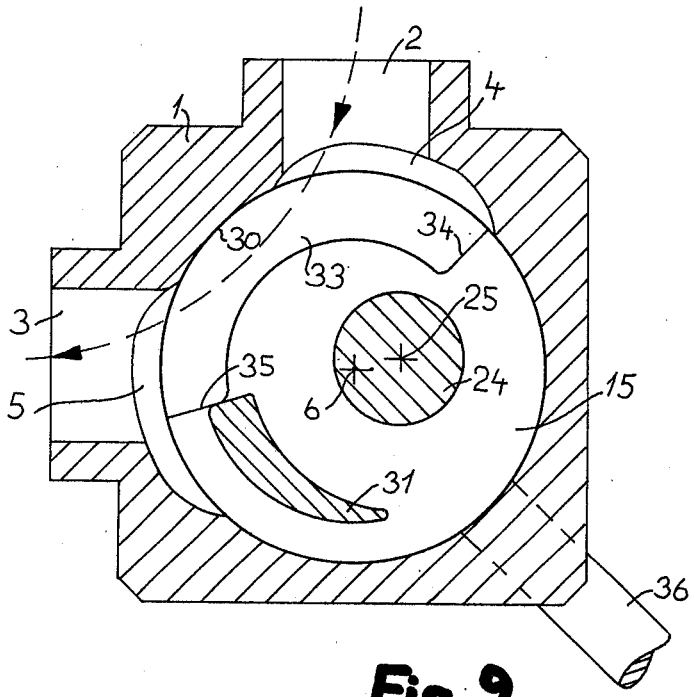

In the inner surface of the cover 15 a duct or recess 33 has been cut out as it appears clearly from FIGS. 3 and 4. In the normal working condition of the pump, cf. FIGS. 2 and 3, one end 34 of the duct 33 is positioned at the transition between the diverging section 5 of the pump outlet 3 and the area 30 along the inner surface of the housing at which full tooth engagement between the two gear wheels occurs. The other end 35 of the duct 33 is positioned, in the working condition of the pump, FIG. 3, behind the diverging section 5 of the inlet 3 as seen in the direction of rotation, and in the embodiment illustrated in FIGS. 1–4, the sickle-shaped projection 31 has been shortened a little at the end 35 of the duct 33 compared with the blocking members normally used in connection with rotary gear pump.

A radially extending operating arm 36 is secured to the cover 15. By means of the operating arm 36 the cover 15 may be rotated in the opening 14 of the housing, from the angular position illustrated in FIG. 3 to the angular position shown in FIG. 4, after the pressure on the pressure shoe 22 has been relieved. In the position shown in FIG. 4 the ends of the duct 33 overlap both the inlet 2 and the outlet 3, and accordingly, in this shifted condition of the pump, liquid may be passed directly through the pump from the inlet 2 to the outlet 3. As it appears from FIGS. 3 and 4 the cover 15 is rotated an angle of 65° in order to shift the pump. Such angular shifting will simultaneously remove the area along which full engagement exists between the teeth of the gear wheels from the area of the inner surface of the housing between the inlet 2 and the outlet 3 in such a way that after such shifting only portions of the gear wheels, the teeth of which are spaced, will be positioned within this area and, accordingly, it is also possible, in the shifted position, to pass liquids through the spaced gear wheels.

This further flushing possibility is increased further in the embodiment illustrated in FIGS. 5–9. The sole difference between the embodiment according to FIGS. 1–4 and the embodiment according to FIGS. 5–9 is that the length of the duct 33 has been increased in the embodiment according to FIGS. 5–9 and, simultaneously, the length of the blocking member 31 has been reduced correspondingly. In FIGS. 5–9 the same references have been used as in FIGS. 1–4 and, accordingly, the operation of the embodiment according to FIGS. 5–9 will be understood without further explanations. From the positions of the arm 36 in FIGS. 7 and 9 it will be understood that the angle of rotation carried out by shifting the pump is greater according to the embodiment in FIGS. 5–9 than according to the embodiment in FIGS. 1–4. First of all, the increased length of the duct 33 results in an increased overlapping of the ends of the duct with respect to the inlet and the outlet as it appears from FIG. 9 and, furthermore, the engagement area between the two gear wheels, cf. FIG. 8, has been moved such a distance past the inlet 2 that a possibility of flow-through exists from the inlet 2 to the outlet 3 between the top circles of the two gear wheels, viz. through the interspace which, in conventional gear pumps of the kind here in question, will be occupied by a blocking member formed as a full sickle.

The short length of the sickle-shaped blocking member does not cause any technical drawbacks. From FIG. 6 it will be seen that a tooth of the smaller gear wheel, during normal operation of the pump, will always enter into sealed engagement with the inner surface of the blocking member 31 before the sealed engagement of the preceding tooth against the blocking member 31 ceases. Accordingly, the blocking against reverse flow through the pump is maintained in spite of the short length of the blocking member 31. Moreover, security against reverse flow through the pump is achieved along the outer surface of the blocking member 31 due to the sealed engagement of the tops of the teeth of the greater gear wheel against the outer surface of the blocking members 31.

By means of the operating arm 36 the cover 15 may easily be shifted manually. However, due to the fact that the cover 15 is rotatable, it may also easily be shifted automatically because the arm 36 may be connected to a hydraulic or pneumatic operating device which is controlled automatically.

I claim:

1. A rotary gear pump comprising two excentrically arranged gear wheels of different sizes, of which the greater gear wheel is rotatably mounted in the generally cylindrical housing of the pump and the smaller gear wheel is mounted upon a shaft which is arranged excentrically in the housing of the pump in such a way that the teeth of the two gear wheels, in the working condition of the pump, are mutually engaged along an area of the inner circumference of the housing of the pump between the outlet of the pump and the inlet of the pump, and are arranged with an interspace between the top circles of the teeth along another part of the circumferences of the wheels, a blocking member being arranged in the interspace with one surface of the blocking member sealing against teeth of the smaller gear wheel and with another surface of the blocking member sealing against teeth of the greater gear wheel, wherein the shaft and the blocking member are mounted rotatably in the housing about the axis of the greater gear wheel together with an element of the housing wherein a duct is provided which, as seen in the circumferential direction of the housing, extends along an angle which is greater than the angle between the inlet of the pump and the outlet of the pump, said duct, moreover, being offset in the circumferential direction with respect to the area along which the greater and the smaller gear wheels engage.

2. A rotary gear pump according to claim 1, wherein the length of the blocking member, as seen in the circumferential direction, is shorter than the length, also as seen in the circumferential direction, of the interspace between the top circles of the teeth of the two gear wheels, one end of said duct, moreover, being arranged approximately at one end of the blocking member.

3. A rotary gear pump according to claim 1, wherein the rotatability of the element of the housing, wherein the duct is provided, is sufficient for shifting the area of engagement between the gear wheels from one side of the inlet of the pump to the other side thereof.

* * * * *